US011581663B1

(12) United States Patent
Marrero Fontanez et al.

(10) Patent No.: US 11,581,663 B1
(45) Date of Patent: Feb. 14, 2023

(54) SHAPED REFLECTOR DUAL S-BAND AND KA-BAND HIGH GAIN ANTENNA

(71) Applicant: United States of America as represented by the Administrator of NASA, Washington, DC (US)

(72) Inventors: Victor Marrero Fontanez, Greenbelt, MD (US); Cornelis Du Toit, Ellicott City, MD (US); Aaron Dabrowski, Arlington, VA (US)

(73) Assignee: United States of America as represented by the Administrator of NASA, Washington, DC (US)

( * ) Notice: Subject to any disclaimer, the term of this patent is extended or adjusted under 35 U.S.C. 154(b) by 0 days.

(21) Appl. No.: 17/319,195

(22) Filed: May 13, 2021

Related U.S. Application Data

(60) Provisional application No. 63/074,190, filed on Sep. 3, 2020.

(51) Int. Cl.

| | |
|---|---|
| ***H01Q 21/30*** | (2006.01) |
| ***H01Q 9/04*** | (2006.01) |
| ***H01Q 15/00*** | (2006.01) |

(52) U.S. Cl.
CPC ..... *H01Q 21/30* (2013.01); *H01Q 9/0478* (2013.01); *H01Q 15/0013* (2013.01)

(58) Field of Classification Search
CPC .... H01Q 19/028; H01Q 19/136; H01Q 19/18; H01Q 19/193; H01Q 19/195; H01Q 9/0478; H01Q 15/0013
See application file for complete search history.

(56) References Cited

U.S. PATENT DOCUMENTS

| | | | | |
|---|---|---|---|---|
| 3,438,041 | A * | 4/1969 | Holtum, Jr. | H01Q 19/193 343/836 |
| 5,373,302 | A * | 12/1994 | Wu | H01Q 5/45 343/781 CA |
| 6,252,559 | B1 * | 6/2001 | Donn | H01Q 19/195 343/781 CA |
| 2013/0050048 | A1 | 2/2013 | Green et al. | |

* cited by examiner

*Primary Examiner* — Daniel Munoz
(74) *Attorney, Agent, or Firm* — Christopher O. Edwards; Bryan A. Geurts; Helen M. Galus

(57) ABSTRACT

An apparatus for space and terrestrial communication applications includes a Ka-band horn combined with a S-band cross-polarization cup. The S-band cross-polarization cup is placed around a neck of the Ka-band horn in a form of a collar.

16 Claims, 9 Drawing Sheets

SHAPED REFLECTOR DUAL S-BAND AND KA-BAND HIGH GAIN ANTENNA

STATEMENT OF FEDERAL RIGHTS

The invention described herein was made by employees of the United States Government and may be manufactured and used by or for the Government for Government purposes without the payment of any royalties thereon or therefore.

FIELD

The present invention relates to antennas, and more particularly, to a dual S-band and Ka-band, circularly polarized high gain antenna (HGA).

BACKGROUND

A large diameter, dual frequency, circularly polarized reflector antenna with an as low as possible depth was required. Thus, the reflector F/D ratio (the focal length divided by the reflector diameter) required had to be close to 0.25, as that provides the overall minimum antenna depth, with the prime reflector focus near the aperture plane. The consequence is a relatively large primary reflector depth requirement, about equal to the overall antenna depth.

The current antenna invention is inspired by prior art, in particular the smaller Lunar Reconnaissance Orbiter (LRO) HGA, where the low frequency feed antenna is placed at the primary reflector feed, and the high frequency system includes a secondary reflector with the high frequency feed antenna placed at one of the foci of the secondary reflector. The secondary reflector, which is reflective over the high frequency band, is essentially transparent to the low frequency band, by means of a frequency selective surface (FSS) that also acts as a radome for the low frequency feed antenna.

The low F/D ratio required a low frequency feed antenna that has a relatively wide beam with low cross-polarization covering the full hemisphere, to fully illuminate the primary reflector. Current state of the art, such a s S-band feed antennas of the LRO HGA and the Global Precipitation Measurement Mission (GPM) HGA do not have wide enough beams. Although the latter has the desired low cross-polarization over a wide angular range, a feed antenna with a higher front to back ratio (i.e. the amount of radiation energy radiated forward versus the energy radiated backward) than either of these prior art could provide, was also desired.

The LRO antenna's secondary reflector was relatively small and of low curvature depth, which simplified fabrication of the FSS, as it could be approximated with two conical sections with minimal deviation from the desired curvature. For the current invention, a larger secondary reflector with a deeper profile was required, which could not be divided into just a few conical segments without significantly larger deviations from the ideal curvature.

The LRO HGA high frequency feed antenna employed a relatively expensive, corrugated horn antenna, with very few vendors prepared to take on the challenge of fabricating it, and who required long lead times. Other easier to fabricate prior art horn antennas include the Potter horn, but it has a narrower bandwidth, and typically higher sidelobes and cross-polarization.

Therefore, as the current antenna invention cannot be based directly on any prior art without introducing new modifications and inventions, there is a need for an alternative high gain antenna.

SUMMARY

Certain embodiments of the present invention may provide solutions to the problems and needs in the art that have not yet been fully identified, appreciated, or solved by current antenna technologies. For example, some embodiments of the present invention pertain to a high gain antenna.

In an embodiment, an apparatus for space and terrestrial communication applications includes a Ka-band horn combined with a S-band cross-polarization cup. The S-band cross-polarization cup is placed around a neck of the Ka-band horn in a form of a collar.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

Some embodiments generally pertain to a high gain dual S- and Ka-band, circularly polarized antenna for space and terrestrial communication applications. For purposes of simplicity, the high gain dual S- and Ka-band, circularly polarized antenna will be referred to as "antenna". The antenna may include an integrated prime-fed S-band and Cassegrain-based Ka-band reflector system. The Cassegrain primary and secondary reflectors are designed and shaped for optimal Ka-band gain, while a frequency selective surface on the secondary reflector provides reflectivity at Ka-band. The secondary reflector and frequency selective surface may act as a dielectric radome for the S-band feed antenna.

In some embodiments, the antenna is suited for lunar missions and beyond, or in long range terrestrial communications, where the large distances and high data rates require an antenna with as much high gain as possible within given size constraints. Some embodiments include an improved S-band feed antenna and cross-polarization compensation, improved Ka-band horn, and special shaping of the secondary reflector for easy of fabrication, all of which will be described in more detail below.

Some embodiments were motivated by the communications requirements for the Roman Space Telecope (RST) mission, which may send an infrared space telescope to orbit at the earth-sun L2 Lagrange point 1.5 million km from earth. As noted above, the antenna requires as much high antenna gain as possible, especially at the Ka-band, while meeting size constraints imposed by the launch vehicle, the practical mounting considerations and antenna steering capabilities of the spacecraft. Further, some embodiments were inspired by the lunar reconnaissance orbiter (LRO) and Cassini missions, which similarly employed multi-band high gain communication antennas.

Figure 1:
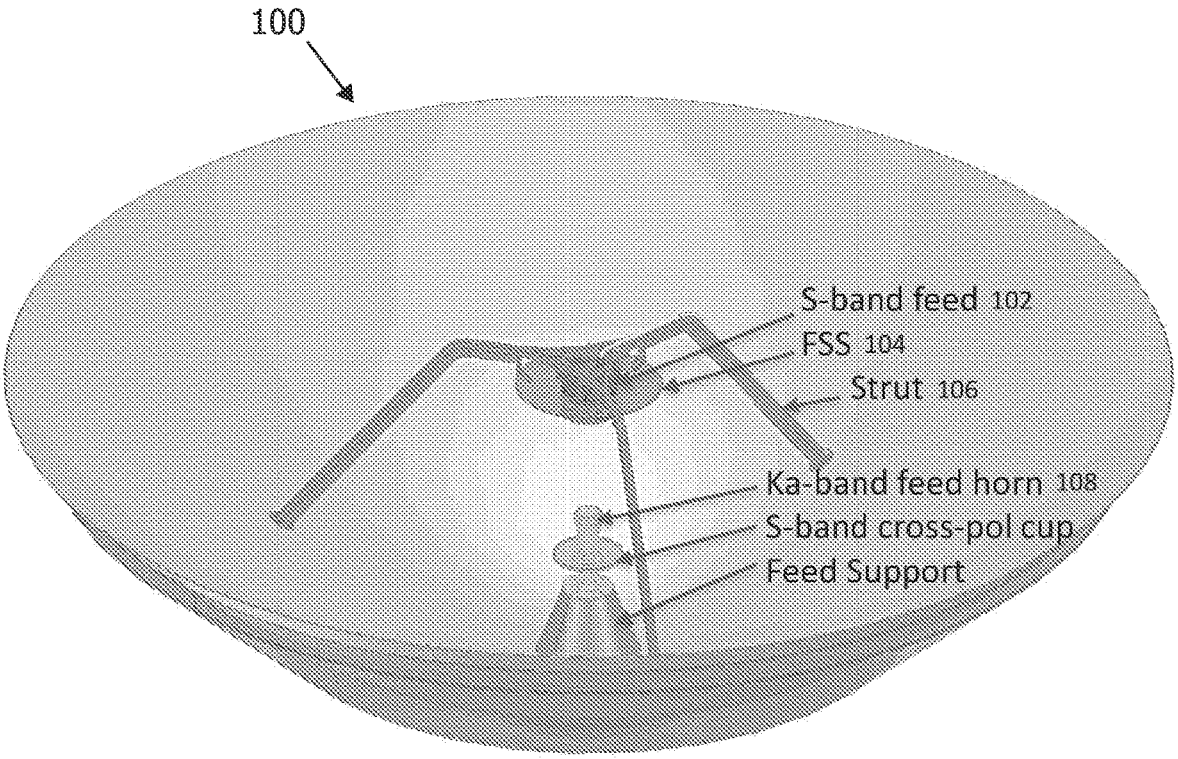
FIG. 1 is a diagram illustrating a dual frequency reflector antenna, according to an embodiment of the present invention.

FIG. 1 is a diagram illustrating a dual frequency reflector antenna 100, according to an embodiment of the present invention. In some embodiments, S-band feed antenna 102 and frequency selective surface (FSS) 104 are supported by struts 106, positioning S-band feed phase center at the primary reflector focus, and forcing FSS 104 to act as a secondary reflector for the Cassegrain-based Ka-band dual-reflector system, while acting as a transparent radome for the S-band feed. Also, in this embodiment, Ka-band feed horn 108 phase center is positioned at the Ka-band system's secondary focal point.

For Ka-band operation, Ka-band feed horn 108 illuminates FSS 104, which in this frequency band is highly reflective. The reflection from FSS 104 (or the secondary reflector) illuminates the primary reflector, which then produces a coherent, narrow Ka-band beam. The primary and secondary reflectors are not paraboloid and hyperboloid surfaces respectively as in a standard Cassegrain system. Instead, these reflectors are shaped to provide an aperture wavefront of uniform phase and amplitude, for optimal aperture efficiency. For even higher efficiency, the secondary reflector shaping also diverts radiation energy away from the central part of the primary reflector that would otherwise have been obstructed by the secondary reflector itself.

S-Band Feed Antenna

Figure 2:
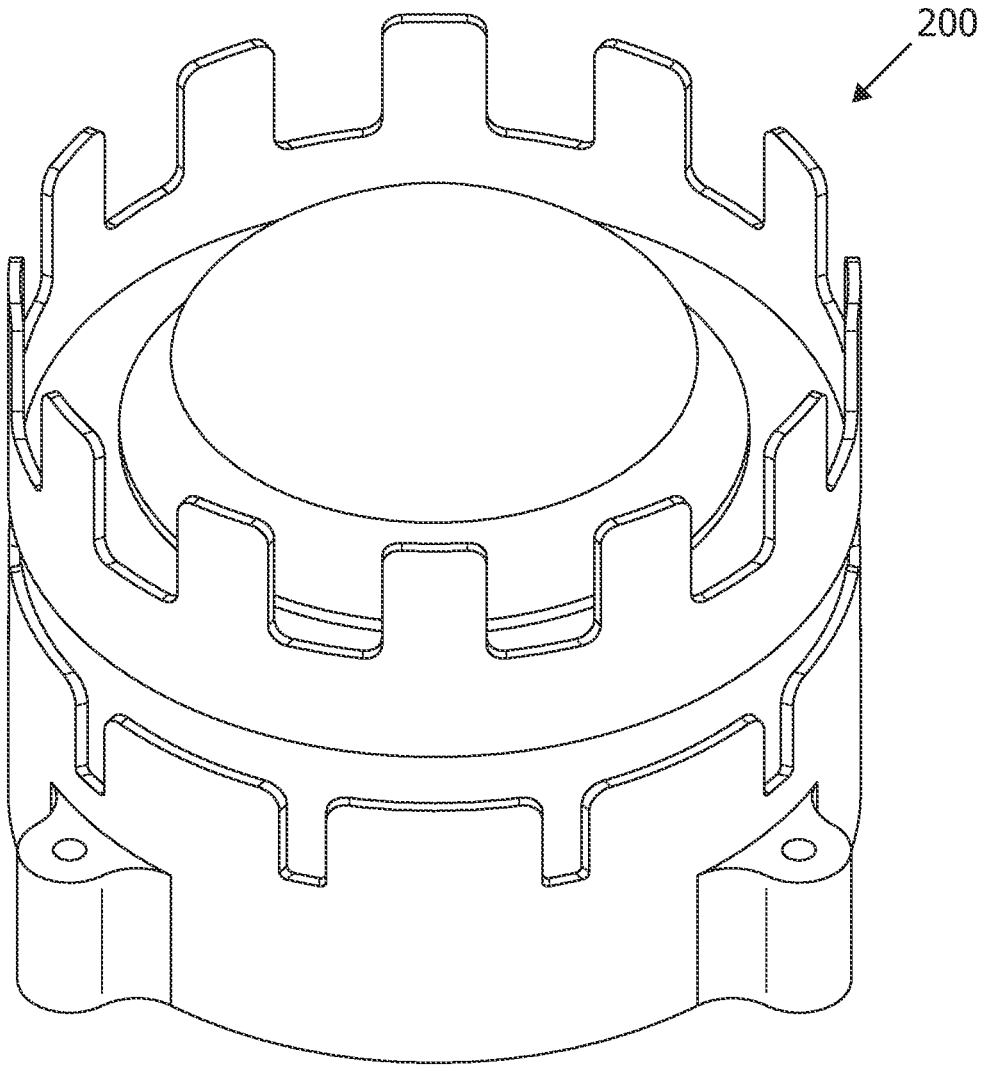
FIG. 2 is a diagram illustrating a conventional S-band feed antenna.

FIG. 2 illustrates a S-band feed antenna 200, which is based on prior art described in more detail in U.S. Patent Application Publication No. 2013/0050048. S-band feed antenna 200 has low cross-polarization over a wide field of view due to the use of spherical domed resonant elements surrounded by a circular wall featuring finger-like protrusions. For simplicity, antenna 200 has a reactive feed mechanism that produces circular polarization from a single input port.

Some embodiments, however, improve on the prior art's front to back ratio, i.e. the amount of radiation energy radiated forward versus the energy radiated backward. A significantly higher front to back ratio is achieved in these embodiments by the introduction of a circumferential choke slot in the cylindrical side of the antenna, without increasing the antenna footprint. The antenna beam width is also increased by reducing the diameter of the outer circular wall diameter. The frequency bandwidth over which the improved front to back ratio is effective, is increased by the use of notches in the choke wall.

Ka-Band Feed Horn

Figure 3:
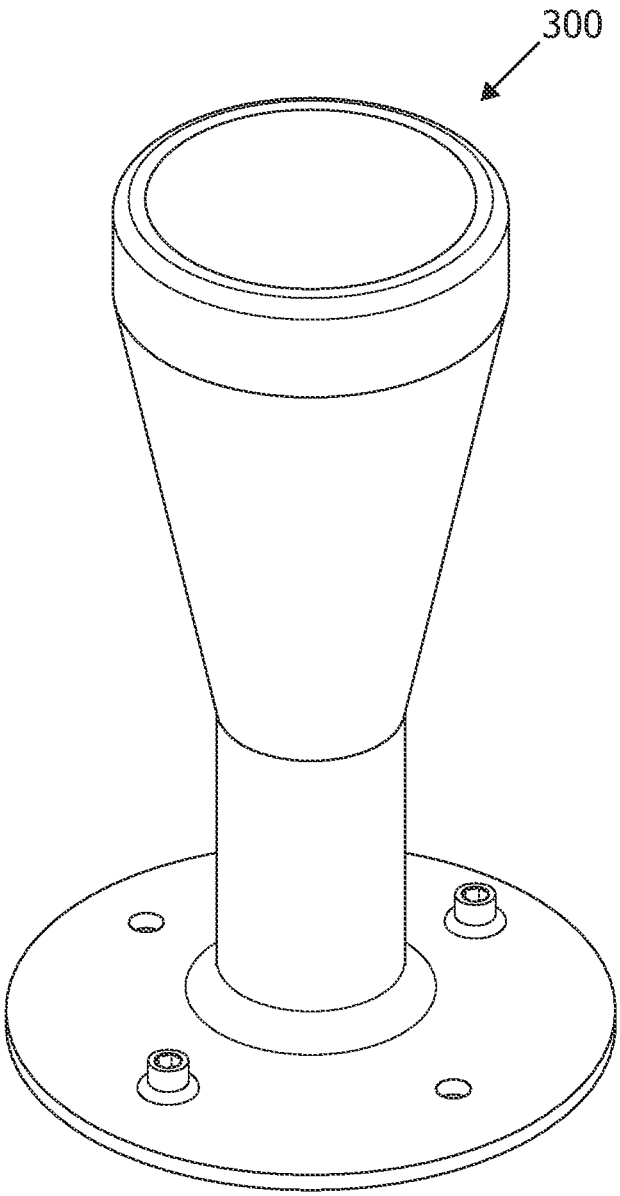
FIG. 3 is an image of a Ka-band feed horn, according to an embodiment of the present invention.

FIG. 3 is an image of a Ka-band feed horn 300, according to an embodiment of the present invention. Although Ka-band feed horn 300 is derived from a Potter horn design, described in P.D. Potter—A New Horn Antenna with Suppressed Sidelobes and Equal Beamwidths—JPL technical Report No. 32-354, Feb. 25, 1963. Ka-band feed horn 300 in some embodiments improves on the standard Potter horn with significant lower sidelobe and cross-polarization level performance. This is achieved by employing a modified smooth S-curved interior profile, instead of the conical plus short cylindrical section that is typical of the standard Potter horn.

Normally, a corrugated horn has been used to achieve the lower required sidelobes. A corrugated horn also has the added advantage of a wider frequency band of operation than a standard Potter horn, but for some applications, the narrower Potter horn bandwidth suffices. The smooth interior walled Potter horn is simpler and less expensive to fabricate than a corrugated horn. Therefore, the modified Potter horn embodiment with its low side-lobe performance is desirable for relatively narrow band applications.

S-Band Cross-Polarization Cup

Some embodiments utilize a S-band cross-polarization cup to reduce the antenna cross-polarization in the S-band. This is achieved by cancelling reflections back to the S-band feed antenna that reflects off the central part of the reflector, the Ka-band horn and its support structure. Without the S-band cross-polarization cup, interaction of these reflections with the S-band feed results in increased S-band cross-polarization. This is especially relevant if the feed antenna has a simple reactive feed structure as opposed to a dual polarization feed mechanism that would have allowed the reflections to be absorbed into a terminating load instead of being re-radiated.

Figure 4:
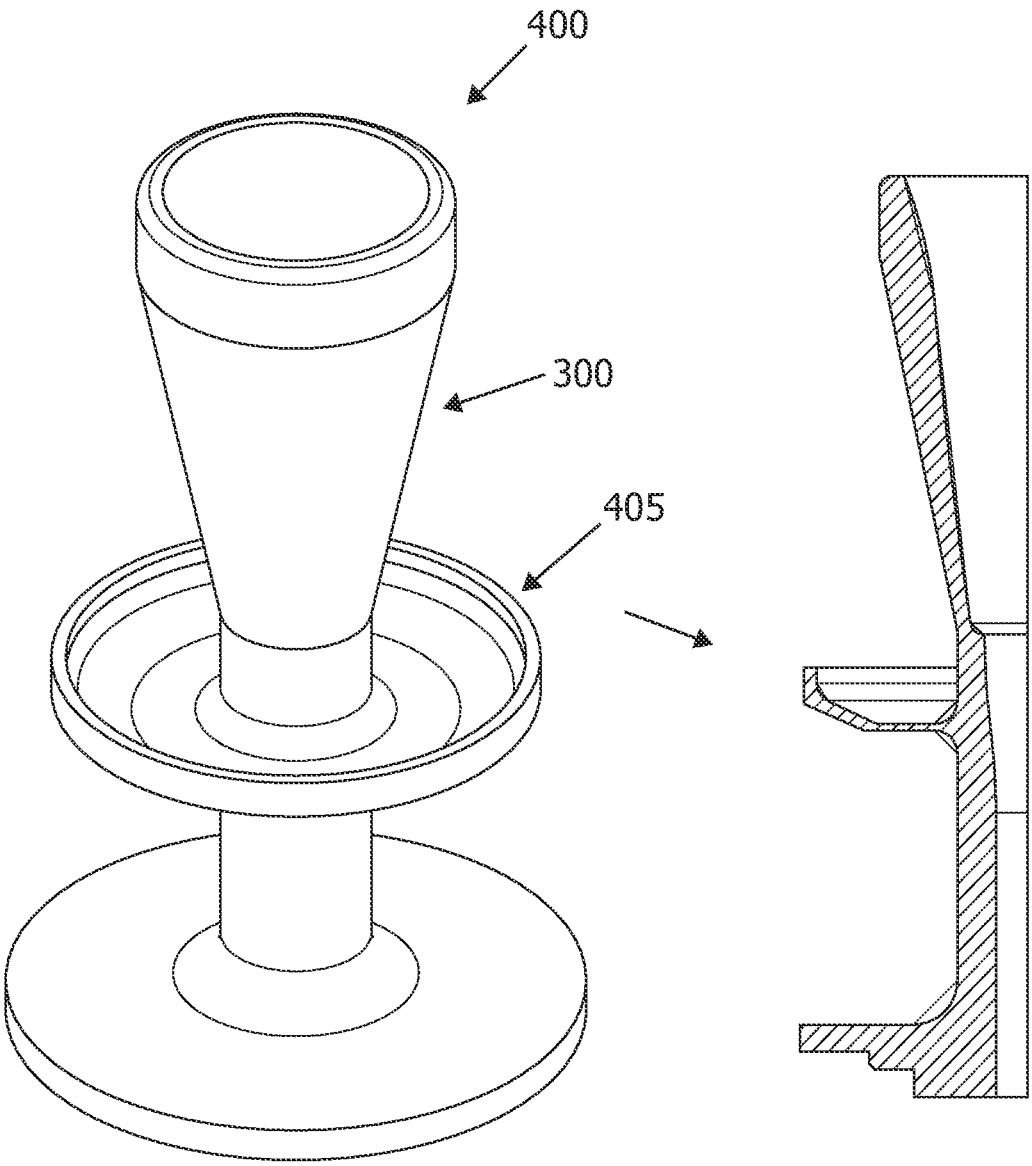
FIG. 4 is an image illustrating a Ka-band horn combined with a S-band cross-polarization cup, according to an embodiment of the present invention.

A cross-polarization cancellation cup has been used in the LRO and GPM high gain antennas, and in other embodiments. Some embodiments may combine the cross-polarization cup with the Ka-band horn geometry. See, for example, FIG. 4, which is an image 400 illustrating a Ka-band horn 300 combined with a S-band cross-polarization cup 405, according to an embodiment of the present invention. In some embodiments, cup 405 is placed around a neck of the Ka-band horn 300 in the form of a collar. This allows cup 405 and horn 300 to be fabricated together, simplifying the overall fabrication and assembly process.

The curvature of cup 405 is used for mechanical strength reasons. The operation of cup 405 is solely governed by its diameter and position with respect to the horn aperture. The curvature, and the lip along the edge, of cup 405 greatly increases the stiffness compared to a flat annular disk with the same diameter and mass.

Primary Reflector and FSS Shaping

Figure 5:
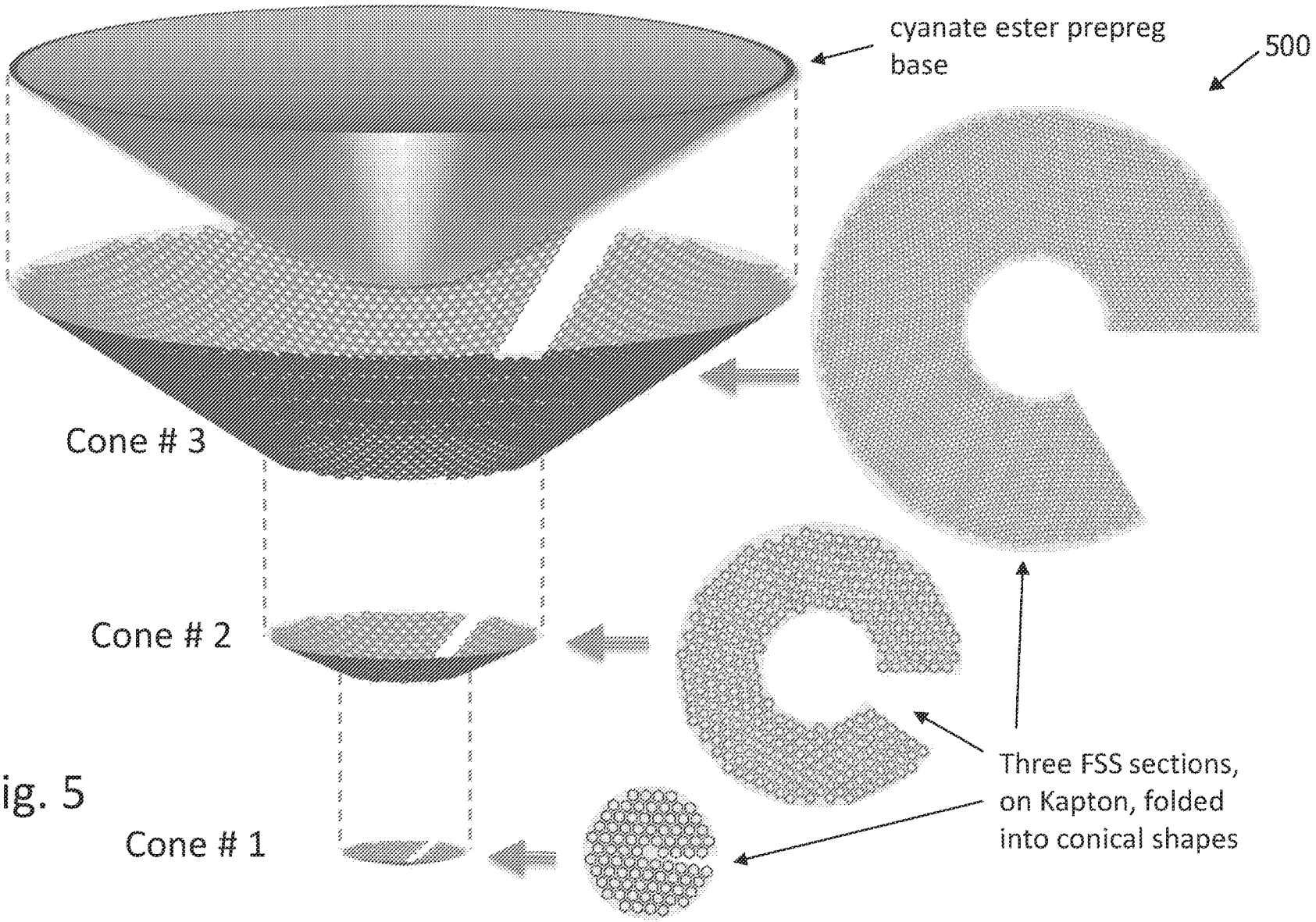
FIG. 5 is a diagram illustrating a frequency selective surface, according to an embodiment of the present invention.

The typical shaping algorithms that modifies the standard Cassegrain reflector system for optimized gain, leads to smoothly curved reflector surfaces. The fabrication of a FSS that conforms to the required curved secondary surface is very problematic. Some embodiments overcome this problem by breaking the FSS up into multiple conical sections that approaches the ideal optimized shape. See FIG. 5, which is a diagram 500 illustrating a frequency selective surface—broken into three conical sections. In FIG. 5, the design employs Hexagonal ring resonators to be printed on Kapton sheets and folded into three conical parts for co-assembly with a non-conductive fiber reinforced prepreg, such as Kevlar fiber reinforced cyanate ester prepreg. To facilitate fabrication, the ideal, optimally shaped secondary curvature was approximated by conical sections, aiming for minimal deviation. This causes a phase error distribution in the aperture, as well as negligible amplitude errors. The phase errors are countered by re-shaping the primary reflector curvature, restoring the uniform aperture phase distribution.

Going into more detail, as shown in FIG. 5, there may be multiple sections—Cone #1, Cone #2, and Cone #3. For each conical section, the FSS metallic features are precision-etched onto thin flat sheets, that are curved into the required conical shapes when attached to the dielectric support structure. The conical sectioned approximations (to the ideal secondary surface), shown for a 20 wavelength diameter FSS, kept the deviations from the ideal surface to less than 0.03 wavelength. These would cause amplitude and phase errors in the antenna aperture wavefront, but reshaping of the primary surface compensates for the phase errors. The loss in gain due to the remaining amplitude errors can be kept to a negligible quantity less than 0.1 dB, by using enough segments in the curvature approximation.

The reflected phase and amplitude response of an FSS in general varies somewhat depending on the polarization and the wave's angle of incidence. Each point on the FSS in this case experience different but predictable incident wave angles. Therefore, the FSS's resonant components are sized and shaped accordingly to provide a response with minimal phase and amplitude errors for both polarizations over the whole surface.

Figure 6:
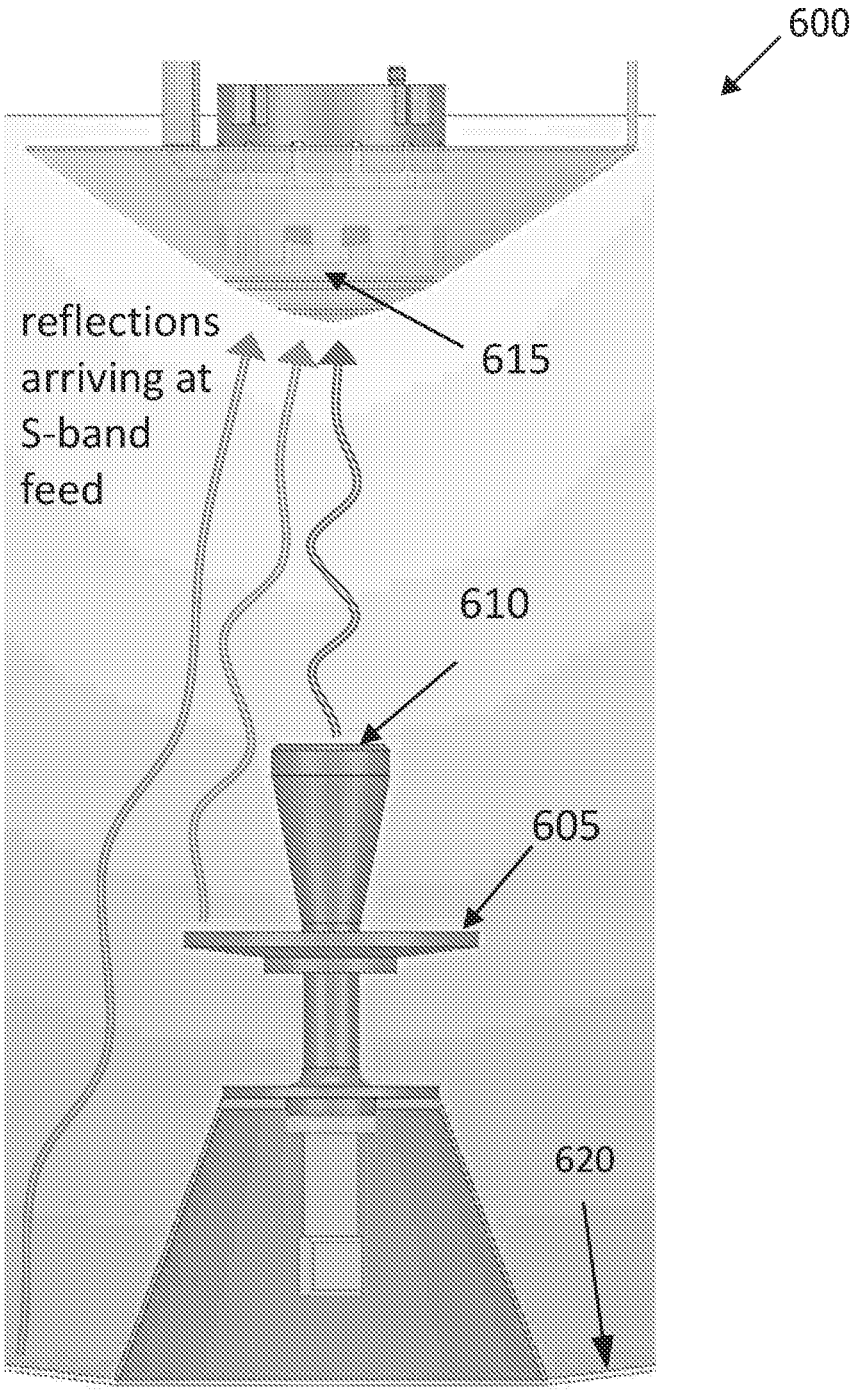
FIG. 6 is a diagram illustrating a side view of a dual frequency reflector antenna, according to an embodiment of the present invention.

FIG. 6 is a diagram illustrating a side view of a dual frequency reflector antenna 600, according to an embodiment of the present invention. In this embodiment, a S-band cross polarization cup 605 is coupled to or attached around Ka-band horn 610. S-band cross polarization cup 605 may cancel reflected energy from primary reflector 620 and Ka-band horn 610 structure, which arrives at the S-band feed antenna cross-polarized, and are thus rejected and re-radiated coherently, increasing cross-polarization in the main beam region. For example, by scattering the reflections away from S-band feed 615, S-band cross-polarization cup 605 increases the co-polarization sidelobe energy somewhat, while preserving good axial ratio at boresight.

In some embodiments, S-band cross polarization cup 605 is designed experimentally, or by way of simulations, by monitoring the boresight radiated cross-polarization in a transmit mode setup. If the S-band feed's circular polarization is created by 3 or more phased internal feed points, then a computationally more efficient technique in a simulation environment is by monitoring the S-band feed's active S11 reflection coefficient at one of the internal feed points in the presence of the primary reflector assembly. The reflected energy at the internal feed points leads to zero combined energy exiting the feed port, but re-combines as re-radiated cross-polarization.

Figure 7:
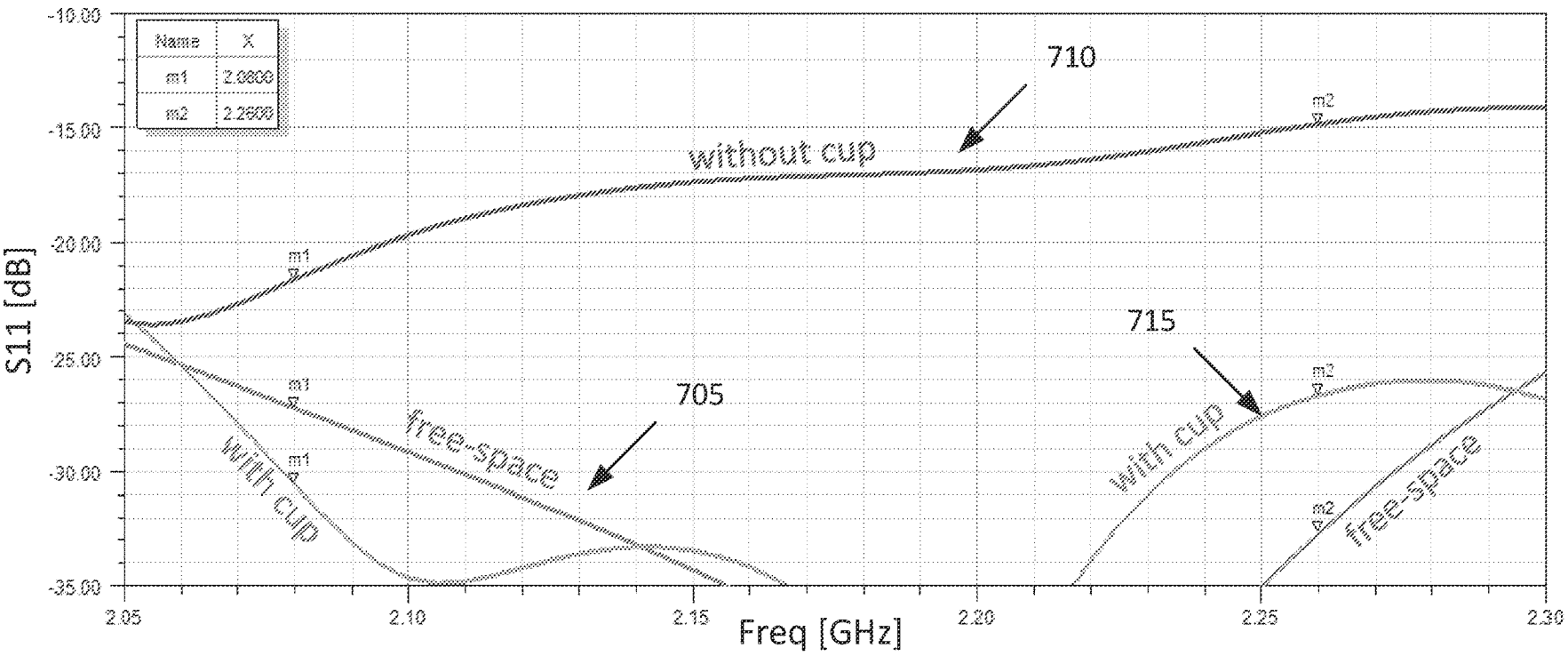
FIG. 7 is a graph illustrating active reflection coefficient S11 at one of the internal feed points, according to an embodiment of the present invention.

FIG. 7 is a graph 700 illustrating active reflection coefficient S11 at one of the internal feed points, according to an embodiment of the present invention. The reflection coefficient S11 represents per definition the fraction of energy that would be reflected back to the input port, but it also represents the fraction of energy that would eventually be radiated as cross-polarization in this case, which is explained as follows.

Since the internal feed points are phased to provide circular polarization, the reflected energy arrives out of phase at the input port, and is once more reflected back to the feed points. It arrives with three times the amount of the original phasing—which is exactly the phase configuration for the opposite handed circular polarization, and is therefore radiated as cross-polarized energy. In the graph, "free-space" curve 705 represents the internal port reflection S11, and hence the fraction of radiated cross-polarization energy when the antenna is placed in a free-space environment. Similarly, "without cup" curve 710 represents the cross-polarized radiated energy in the presence of the high gain antenna assembly, when a "cross-polarization" cup is absent. The "with cup" curve 715 represents the cross-polarized radiated energy in the presence of the high gain antenna assembly, but with an optimized "cross-polarization" cup installed. Therefore, graph 700 shows that the cross-polarization cup in the HGA environment restores the radiated cross-polarization energy of the S-band feed antenna similar to the low levels it exhibits in a free space environment.

These embodiments may be used to exploit feed antennas, i.e., the Ka-band horn and/or the S-band feed antenna, where robust mechanical properties and low electrical losses are premium such as antennas for spacecraft or vehicles, where high vibration environment require these properties. These antennas may also be scaled to operate at frequency bands other than Ka-band or S-band. The high gain antenna system can be commercially applied in terrestrial situations, where high data rate communications are required between line-of-site points such as in the Telecommunications industry.

Figure 8A:
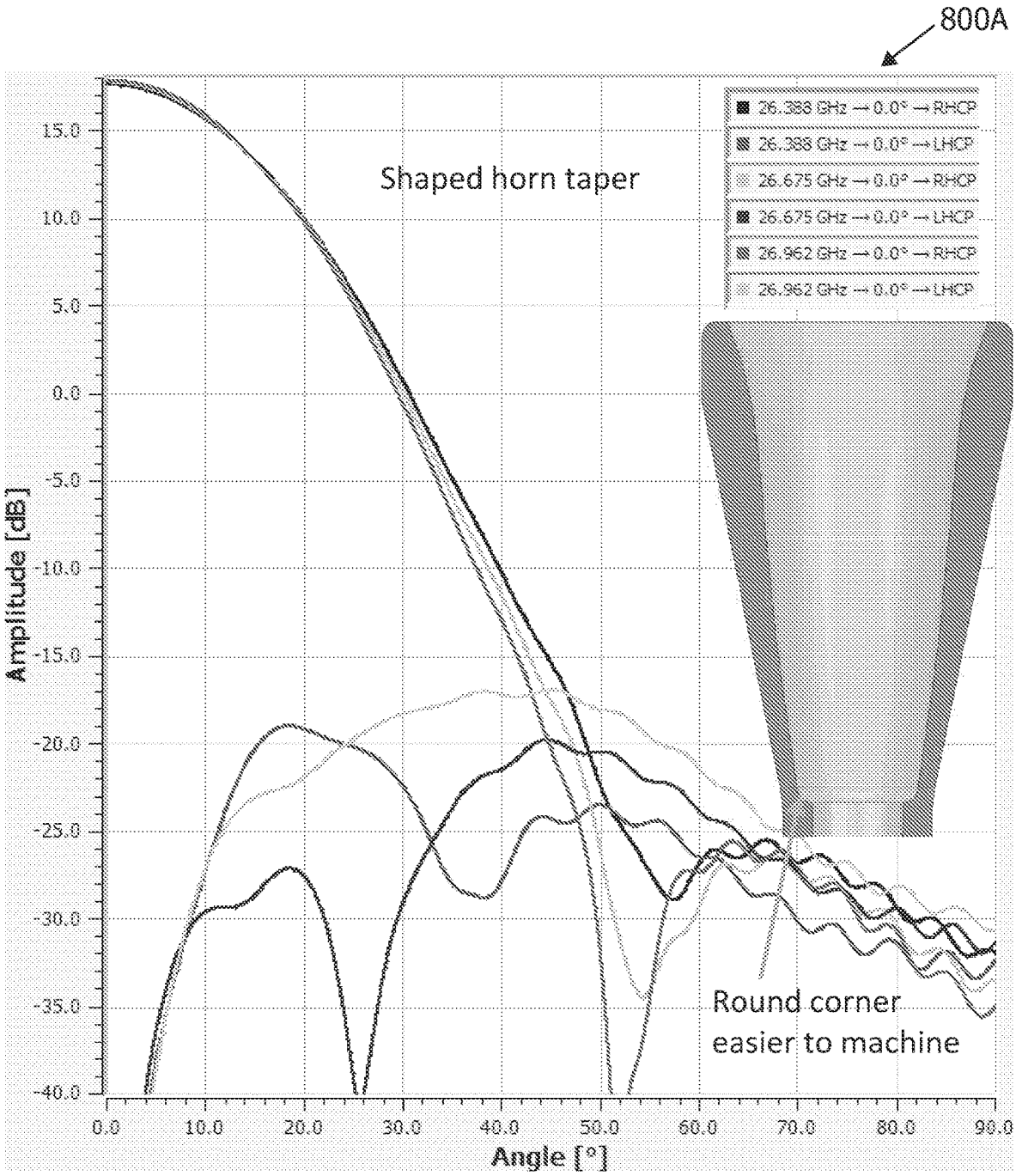
FIG. 8A and FIG. 8B illustrates the improvement in performance as well as ease of fabrication of an embodiment of the present invention.

FIG. 8A is a graph 800A illustrating radiation patterns of the Ka-band Potter horn with an optimally shaped internal profile for improved sidelobe and cross-polarization performance, according to an embodiment of the present invention. Internal corners are also rounded for ease of fabrication.

Figure 8B:
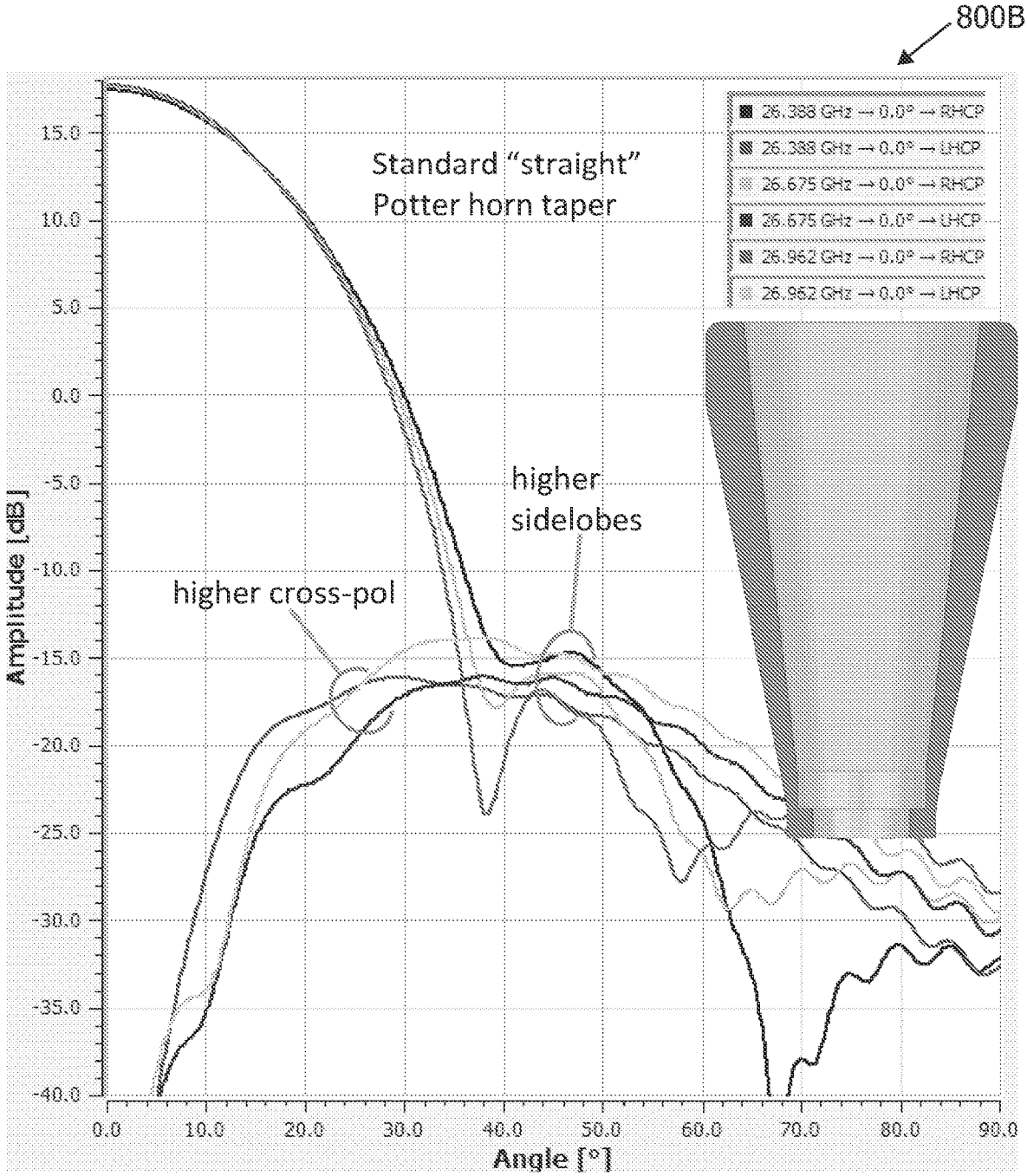

FIG. 8B is a graph 800B illustrating the radiation patterns of a conventional Ka-band Potter horn with the same beam width and gain as the horn in FIG. 8A, but showing higher sidelobes and cross-polarization levels even after optimization. The standard Potter horn assumes sharp internal corners that may be difficult to fabricate, especially in the case of very high frequency applications. Comparison of graph 800A of FIG. 8A and graph 800B of FIG. 8B thereby illustrates the improvement in performance as well as ease of fabrication of an embodiment of the present invention.

It will be readily understood that the components of various embodiments of the present invention, as generally described and illustrated in the figures herein, may be arranged and designed in a wide variety of different configurations with variations on the materials indicated. Thus, the detailed description of the embodiments of the present invention, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skilled in the art that certain modifications, variations, and alternative constructions would be apparent, while remaining within the spirit and scope of the invention. In order to determine the metes and bounds of the invention, therefore, reference should be made to the appended claims.

The invention claimed is:

1. An antenna for use in space and terrestrial communication applications, comprising:

a Ka-band horn with an outer circular wall with a predetermined diameter combined with a S-band cross-polarization cup, wherein the S-band cross-polarization cup is placed around a neck of the Ka-band horn in a form of a collar, whereby said collar includes a circumferential choke slot in a cylindrical side of the Ka-band horn resulting in a constant antenna footprint and increased beam width with a reduced outer circular wall diameter.

2. The apparatus of claim 1, wherein the Ka-band feed horn is configured to illuminate a frequency selective surface (FSS), the FSS being highly reflective, and the highly reflective FSS is configured to illuminate a primary reflector, producing a coherent, narrow Ka-band beam.

3. The apparatus of claim 1, wherein the Ka-band feed horn improves on a standard Potter horn with significant lower sidelobe and cross-polarization level performance by employing a modified smooth S-curved interior profile.

4. The apparatus of claim 1, wherein the S-band cross-polarization cup is configured to reduce a cross-polarization in the S-band by cancelling reflections back to a S-band feed antenna that reflects off a central part of the reflector, the Ka-band horn and a support structure of the reflector.

5. A high gain dual S- and Ka-band circularly polarized antenna ("antenna") for space and terrestrial communications, the antenna comprising:

a primary reflector and a secondary reflector designed and shaped for optimal Ka-band gain while a frequency selective surface on the secondary reflector provides reflectivity at Ka-band, wherein the primary reflector is a Cassegrain-based Ka-band reflector with an outer circular wall with a predetermined diameter, and the secondary reflector is a Ka-band reflector combined with a S-band cross-polarization cup, wherein the S-band cross-polarization cup is placed around a neck of the Ka-band horn in a form of a collar, whereby said collar includes a circumferential choke slot in a cylindrical side of the Ka-band horn resulting in a constant antenna footprint and increased beam width with a reduced outer circular wall diameter.

6. The antenna of claim 5, wherein the secondary reflector and the frequency selective surface may is configured to act as a dielectric radome for a S-band feed antenna.

7. The antenna of claim 5, wherein the second reflector and the frequency selective surface are supported by struts, positioning a S-band feed phase center at the primary reflector focus.

8. The antenna of claim 7, wherein the struts supporting the second reflector and the frequency selective surface force the frequency selective surface to act as a secondary reflector for the antenna.

9. The antenna of claim 5, further comprising:

a Ka-band feed horn phase center is positioned at a Ka-band secondary focal point.

10. The antenna of claim 5, wherein the primary reflector is configured to illuminate the frequency selective surface.

11. The antenna of claim 10, wherein the illumination causes a reflection from frequency selective surface or the secondary reflector illuminating the primary reflector, thereby producing a coherent, narrow Ka-band beam.

12. The antenna of claim 5, wherein the primary reflector and secondary reflector are shaped to provide an aperture wavefront of uniform phase and amplitude, for optimal aperture efficiency.

13. The antenna of claim 5, wherein a shape of the secondary reflector diverts radiation energy away from a central part of the primary reflector.

14. The antenna of claim 5, wherein the secondary reflector comprises a S-band cross-polarization cup configured to reduce antenna cross-polarization in the S-band.

15. The antenna of claim 14, wherein the reduction of the antenna cross-polarization in the S-band is achieved by cancelling reflections back to a S-band feed antenna that reflects off a central part of the secondary reflector, the primary reflector and support structures.

16. The antenna of claim 5, wherein a curvature, and a lip along an edge, of the cup increases a stiffness compared to a flat annular disk with a same diameter and mass.

* * * * *